US005718207A

United States Patent [19]

Ito

[11] Patent Number: 5,718,207

[45] Date of Patent: Feb. 17, 1998

[54] FUEL SUPPLY APPARATUS AND METHOD FOR SUPPLYING FUEL ACCORDING TO AN ENGINE OPERATING CONDITION

[75] Inventor: Motoya Ito, Hekinan, Japan

[73] Assignee: Nippondenso Co., Ltd., Kariya, Japan

[21] Appl. No.: 689,643

[22] Filed: Aug. 12, 1996

[30] Foreign Application Priority Data

Aug. 30, 1995 [JP] Japan ..... 7-221985

[51] Int. Cl.[6] ..... F02M 37/04; F02N 17/00

[52] U.S. Cl. ..... 123/497; 123/179.16; 123/458

[58] Field of Search ..... 123/510, 511, 123/495, 497, 506, 458, 459, 462, 179.16, 179.17

[56] References Cited

U.S. PATENT DOCUMENTS

| | | | |
|---|---|---|---|
| 4,800,859 | 1/1989 | Sagisaka et al. | 123/497 |
| 4,926,829 | 5/1990 | Tuckey | 123/497 |
| 5,085,193 | 2/1992 | Morikawa | 123/497 |
| 5,148,792 | 9/1992 | Tuckey | 123/514 |
| 5,284,119 | 2/1994 | Smitley | 123/497 |
| 5,284,120 | 2/1994 | Fukuhima et al. | 123/497 |
| 5,289,810 | 3/1994 | Bauer et al. | 123/510 |
| 5,361,742 | 11/1994 | Briggs et al. | 123/497 |
| 5,398,655 | 3/1995 | Tuckey | 123/497 |
| 5,406,922 | 4/1995 | Tuckey | 123/497 |
| 5,509,390 | 4/1996 | Tuckey | 123/497 |
| 5,558,063 | 9/1996 | Minagawa et al. | 123/497 |
| 5,577,479 | 11/1996 | Popp | 123/458 |

*Primary Examiner*—Thomas N. Moulis

*Attorney, Agent, or Firm*—Nixon & Vanderhye

[57] ABSTRACT

A fuel supply apparatus includes a flow control valve, a housing, a movable portion, a compression coil spring and a coil constructed integrally with a fuel pump (or separately from the fuel pump). The movable portion may be made of magnetic material and attracted to the fuel downstream side against the spring force of the compression coil spring by an electromagnetic attracting force generated by an electric current supplied to the coil. A fuel drain opening can be created by aligning a first communication passage to release an excess part of the fuel passing through fuel passages back to the fuel tank through the drain passage in accordance with an engine operation condition.

18 Claims, 6 Drawing Sheets

STOP

LIGHT-MIDDLE LOAD

FULL LOAD

STOP

LIGHT-MIDDLE LOAD

FULL LOAD

FUEL SUPPLY APPARATUS AND METHOD FOR SUPPLYING FUEL ACCORDING TO AN ENGINE OPERATING CONDITION

CROSS REFERENCE TO RELATED APPLICATION

This application is based upon and claims priority of Japanese patent Application No. Hei 7-221985 filed on Aug. 30, 1995, the content of which is incorporated herein by reference.

BACKGROUND OF THE INVENTION

1. Field of the Invention:

The present invention relates to a fuel supply apparatus having a fuel pump capable of controlling the amount of a fuel to an internal combustion engine (hereinafter simply called an engine) in accordance with an operating condition of the engine.

2. Description of Related Art:

One type of conventional fuel supply apparatus for injecting fuel into respective intake ports by fuel injectors fixed to the respective cylinders of the engine has no return pipe (hereinafter simply called a return-less fuel supply apparatus) for returning to the fuel tank surplus fuel (hereinafter simply called surplus fuel) left over from fuel supplied to a fuel rail or the like delivering fuel to the respective fuel injectors. In the return-less fuel supply apparatus, the amount of fuel delivered to the fuel rail is controlled by controlling the amount of fuel discharged by the fuel pump in accordance with an operating condition of the engine.

An example of such a fuel supply apparatus as well as a method for preventing fuel from being vaporized are disclosed in JP-A-6-50230. In this fuel supply apparatus, an interior fuel line pressure is measured with a pressure sensor and a fuel pump is controlled by transmitting an electrical signal in accordance with the measured pressure value to the fuel pump. In such a feed-back control, the amount of fuel supplied from the fuel pump does not exactly follow with the injected fuel amount due to delayed response of the fuel pump, thereby causing a problem in that the Air-Fuel ratio temporarily becomes rich or lean and thus deviates from the optimum value, especially when the engine load changes. Therefore, an orifice, which is always open, is disposed at a joint between a fuel line and a manifold located between the fuel pump and the engine so as to leak fuel delivered from the fuel pump outside the fuel line. By employing such a structure, since the fuel delivered from the fuel pump leaks outside the fuel line through the orifice in case fuel supply is not needed to the engine, the fuel pump can be continuously operated with a low efficiency. In this way, when fuel demand is low, it is possible to increase the capacity of the fuel pump rapidly in accordance with the high fuel demand while yet maintaining the operation level of the fuel pump at its minimum.

However, according to JP-A-6-50230, the orifice formed at the joint between the fuel line and the manifold is always open, so that fuel always leaks outside the fuel line. In this case, at maximum engine output times, the fuel leaks from this orifice outside the fuel line, thereby causing a shortage of fuel supplied to the engine. Even if additional fuel is discharged to make up for the leaked fuel, the fuel pump has to be operated at a high load condition, thereby causing overload of an alternator and worsening engine fuel consumption. Furthermore, the fuel tank is excessively heated by heat generated by the fuel pump itself, thereby causing another problem in that evaporated fuel may be generated.

When the engine is being started, electric power supplied to the fuel pump decreases in accordance with the decrease of battery voltage caused by the starter motor. Therefore, it is difficult to obtain necessary fuel pressure when the engine is being started, because the fuel delivering capacity of the fuel pump is lowered in accordance with decreased electric power supplied thereto. In this way, a decrease in fuel pressure due to the orifice is facilitated. Accordingly, fuel pressure is prevented from rising rapidly when the engine is being started.

SUMMARY OF THE INVENTION

In light of the above-described problems, an object of the present invention to provide a fuel supply apparatus capable of increasing fuel discharge amount at a low load as well as increasing the capacity of the fuel pump rapidly in accordance with high fuel demand and, further, operating the fuel pump efficiently in a high engine load operating condition.

According to a first aspect of the present invention, in a fuel supply apparatus where the a fuel pump discharge into a fuel supply pipe is controlled according to an engine operating condition, of the fuel pump discharge is drained into the fuel tank in a low load engine operating condition of the engine and no fuel is drained to the tank in a high load engine operating condition.

In this way, it is possible to increase the amount of fuel discharged only in the low load engine operating condition without lowering pump capacity.

Further, fuel discharged from the fuel pump may be drained through a drain passage out of the fuel supply pipe by opening or closing the drain passage with a valve according to a load condition of the engine. That is, the valve opens the drain passage under light load engine or a middle load operation and closes the drain passage in a full load engine operation.

Therefore, when the engine is in a stopping or in a starting condition, fuel discharged from the fuel pump is not drained through the drain passage out of the fuel supply pipe. In this way, it is possible to secure necessary fuel pressure and to start up the engine smoothly. Even if the engine is in a full load operating condition, fuel discharged by the fuel pump is not drained outside the fuel supply pipe through the drain passage, and therefore, it is possible to supply a required fuel amount without any waste. When the engine is in a light or a middle load operating condition, fuel discharged by the fuel pump is drained outside the fuel supply pipe to the fuel tank through the drain passage, and therefore, it is possible to prevent fuel supplied by the fuel pump from being an extremely small amount such as only a few liter/h, because fuel including the leaked fuel which will be drained out of the fuel supply pipe through the drain passage is discharged by the fuel pump. Thus, it is possible to stabilize rotation of the fuel pump as well as to improve the capacity of the fuel pump rapidly in accordance with subsequent high fuel demand, i.e., it is possible actually to supply fuel in accordance with an operating condition of the engine.

Fuel discharged from the fuel pump may be drained by a flow control valve including a cylindrical body forming a fuel passage through which the fuel discharged by the fuel pump passes. A first communication passage in the body forms part of said drain passage. A housing forms a hole slidably accommodating the cylindrical body and a second communication passage forms the remaining part of the drain passage. An opening of the first communication passage, on a side of the second communication passage, is opened or closed by moving the cylindrical body relative to the housing in an axial direction of the sliding hole or in a peripheral direction of the sliding hole. In this way, it is possible to reduce the number of parts required to manufacture the flow control valve as well as to simplify the structure.

According to a second aspect of the present invention, in a fuel supply apparatus where the fuel pump discharge into a fuel supply pipe is controlled according to an engine operating condition, the amount of fuel pump discharge is increased by more than a required amount of fuel in a low load engine operating condition. A differential amount of fuel between the discharged fuel amount and the required fuel amount in a low load engine operating condition is drained through a drain passage to the fuel tank and no fuel is drained in the other load engine operating conditions.

In this way, it is possible to supply a required amount of fuel for the engine as well as to increase the fuel amount discharged by the fuel pump in the low load engine operating condition.

Other objects and features of the invention will be understood in the course of the description, which follows.

BRIEF DESCRIPTION OF THE DRAWINGS

Additional objects and advantages of the present invention will be more readily apparent from the following detailed description of preferred embodiments thereof when taken together with the accompany drawings in which.

DETAILED DESCRIPTION OF THE PRESENTLY REFERRED EMBODIMENTS

Preferred embodiments according to the present invention will be hereinafter described with reference to the accompanying drawings.

A first embodiment of a fuel supply apparatus of the present invention will be described with reference to FIGS. 1–4.

Figure 2:
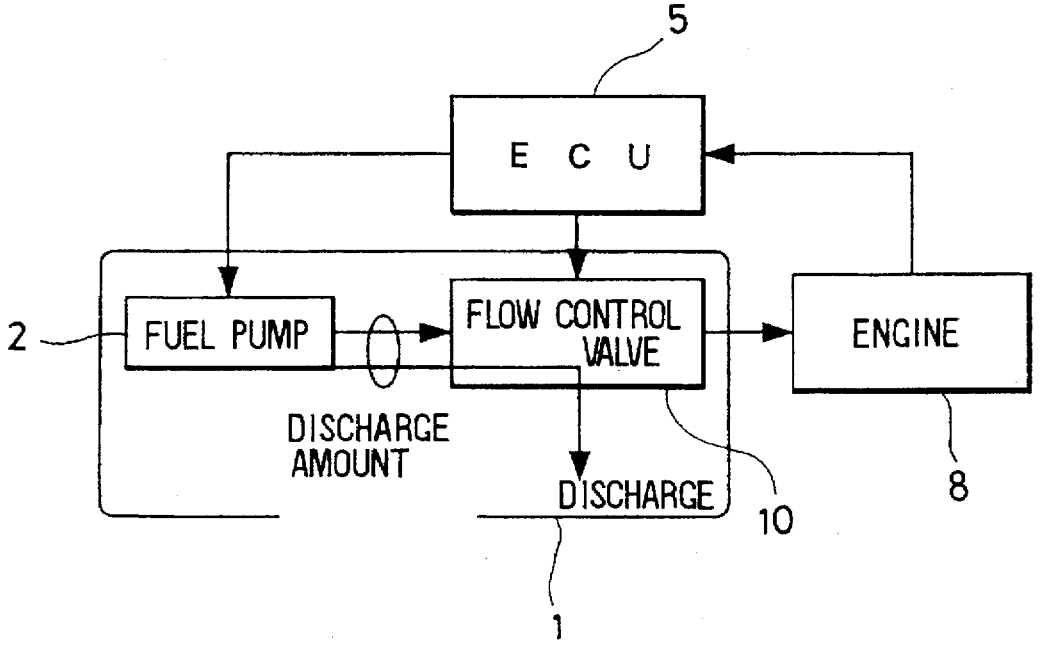
FIG. 2 is a block diagram showing the construction of the fuel supply apparatus according to the first embodiment of the present invention.

As shown in FIG. 2, the fuel supply apparatus includes a fuel pump 2 disposed inside a fuel tank 1, a flow control valve 10 for controlling a flow amount located in the fuel tank 1 on the discharge side of the fuel pump 2, a fuel rail (not shown) for leading fuel, the flow amount of which is controlled by the flow control valve 10 disposed on the downstream side of the flow control valve 10, fuel injectors (not shown) disposed in the fuel rail, the number of the which is equal to that of cylinders, for injecting and supplying the fuel to respective air intake ports of an engine 8, and an electronic control unit (hereinafter simply called an ECU) 5 as fuel pump control means for controlling the flow control valve 10 as well as for controlling rotational speed of the fuel pump 2 in PWM (pulse width modulation) control by a sensor signal from a sensor (not shown) for detecting an operating condition of the engine 8, i.e., a load condition. Each information such as rotational engine, speed intake air amount, degree of accelerator opening fuel temperature or the like are input to ECU 5, to determine a discharge amount of the fuel pump 2 based on such information. The PWM control for the discharge amount is provided to fuel pump 2 by ECU 5.

Fuel pumped by fuel pump 2 is pressurized and supplied to flow control valve 10. The fuel pump 2 controlled by ECU 5 according to an operating condition of engine 8 controls the amount of fuel supplied to engine 8. The amount of fuel drained from flow control valve 10 is controlled by controlling the amount of surplus fuel drained into fuel tank 1 from drain passage 19 (e.g., see FIGS. 3A–3C) by opening or closing drain passage 19 (described below) with valve means, i.e., the surplus fuel subtracted from the discharged fuel from pump 2 is supplied to engine 8.

Figure 1:
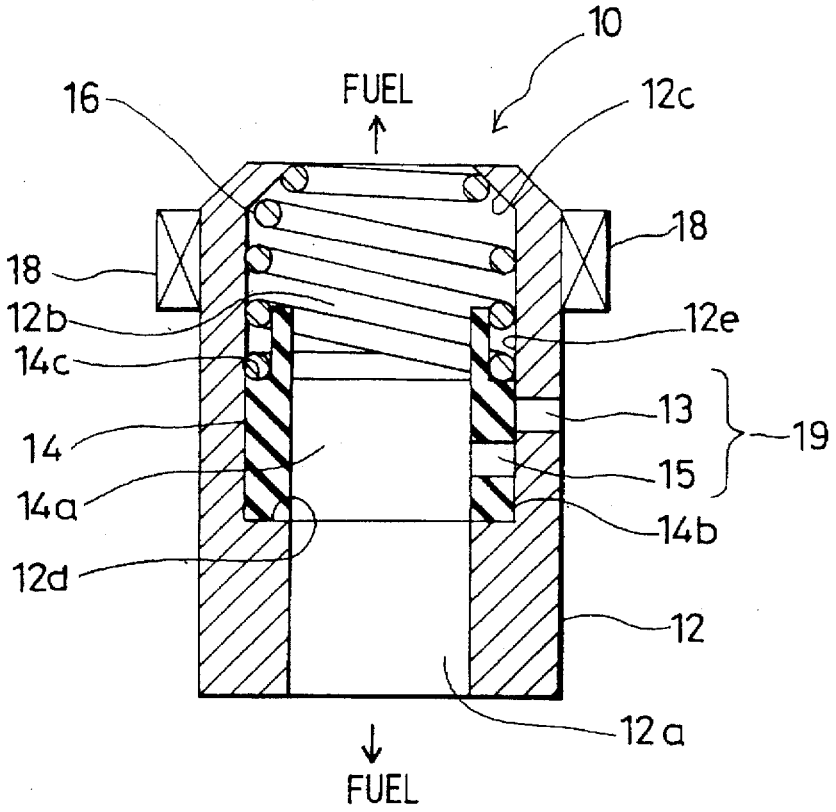
FIG. 1 is a longitudinal cross sectional view of a fuel supply apparatus according to a first embodiment of the present invention.

An exemplary structure of flow control valve 10 will be described based on FIG. 1.

The exemplary flow control valve 10 includes housing 12, movable portion 14, compression coil spring 16 and coil 18, and is integrated with the fuel pump 2 or separated from the fuel pump 2.

The housing 12 made of non-magnetic material forms a fuel passage **12*a* so as to communicate with fuel pump 2. A fuel passage 12*a* is formed at one end of housing 12. On the fuel downstream side of fuel passage 12*a*, there is a sliding hole 12*b* having a larger diameter than the fuel passage 12*a*, communicating with fuel passage 12*a*, and passing through the other end of housing 12. That is, a communicating passage composed of fuel passage 12*a* and sliding hole 12*b* passes through housing 12 from one end to the other end. A stopper 12*d* adopted to contact with one end of movable portion 14 (described below) is formed at the connecting portion between fuel passage 12*a* and sliding hole 12*b*. A tapered portion 12*c* is formed at the other end located on the fuel downstream side of sliding hole 12*b* and contacts with one end of compression coil spring 16 (described below). A second communicating passage 13 of housing 12 is formed on the fuel upstream side of sliding hole 12*b*. The second communication passage 13 serves as a drain passage 19 by communicating with first communication passage 15 formed in the movable portion 14** (described below).

The cylindrical movable portion 14 made of ferromagnetic material is slidable in sliding hole **12*b* of housing 12. That is, the movable portion 14 has an outer peripheral wall 14*b* having a slightly smaller outer diameter than the inner diameter of the sliding hole 12*b* and a fuel passage 14*a* through which the fuel delivered by the fuel pump 2 can pass. When movable portion 14 is accommodated in sliding hole 12*b* of housing 12, movable portion 14 can move in the axial direction, i.e., upward or downward in sliding hole 12*b* in FIG. 1. When the movable portion 14 moves to the fuel upstream side, i.e., downward in FIG. 1, one end contacts stopper 12*d* of housing 12. At that time, the first communication passage 15 passing through the both interior and exterior sides of the wall of movable portion 14 is located on the fuel upstream side from the second communication passage 13 of housing 12. An opening of the first communication passage 1 is so positioned as to be closed by the internal wall 12***e* of sliding hole 12*b* of housing 12. On the other hand, when the movable portion 14 moves in the fuel downstream side, i.e., upward in FIG. 1, the opening of the first communication passage 15 is closed by interior wall 12*e* of sliding hole 12*b* again.

As described above, opening of the first communication passage 15 communicates with the second communication passage 13 or is closed by the interior wall 12*e* of the sliding hole 12*b* depending on the position of the movable portion 14 moving in the axial direction. The movable portion 14 and the interior wall 12*e* constitute a valve.

The compression coil spring 16 is located between the fuel downstream side end portion of the movable portion 14 accommodated in the housing 12 and the fuel downstream side end portion. One end contacts with the taper 12*c* of the housing 12, whereas the other end contacts with a spring seat 14*c* formed on the fuel downstream side end portion of the movable portion 14. In this way, the compression coil spring 16 biases movable portion 14 toward the fuel upstream side. That is, movable portion 14 is shown in FIG. 1 as being maintained in that position biased toward the fuel upstream side by the compression coil spring 16.

A coil 18 is wound around the outer peripheral wall located on the fuel downstream side of the housing 12. The movable portion 14 made of the ferromagnetic material is attracted toward the fuel downstream side resisting the spring force of the compression coil spring 16 by electromagnetic attracting force generated by supplying electric current to coil 18. The amount of movement of movable portion 14 is controlled depending on the voltage applied to coil 18.

Figure 3A:
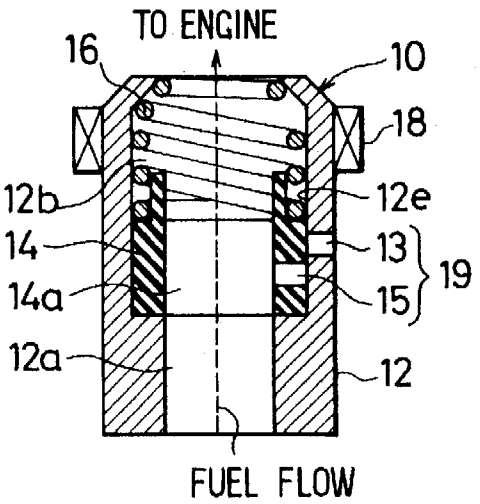
FIGS. 3A–3C show operations of the flow control valve of the first embodiment.
Figure 3B:
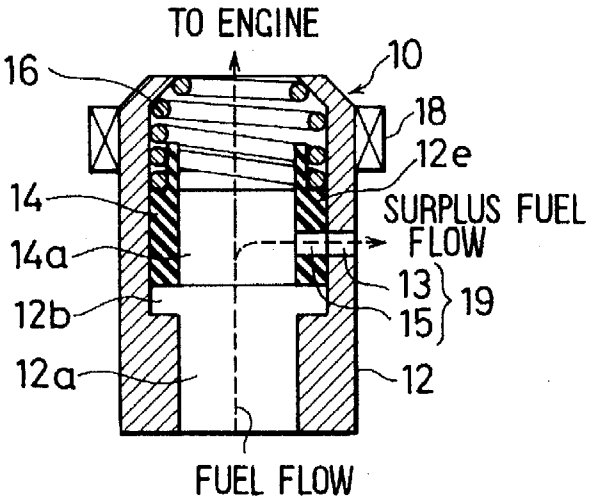

Once movable portion 14 is attracted toward the fuel downstream side, the opening of the first communication passage 15 can communicate with the second communication passage 13 of housing 12. In this way, the first communication passage 15 and the second communication passage 13 form drain passage 19 as shown in FIG. 3B. In the state shown in FIG. 3B, a part of the fuel passing through the fuel passages 12*a* and 14*a* is released back to the fuel tank 1 through drain passage 19 composed of the first communication passage 15 and the second communication passage 13, because the flow control valve is located inside the fuel tank 1 and the fuel released from fuel passages 12*a* and 14*a* in the flow control valve 10 flows into fuel tank 1.

Figure 3C:
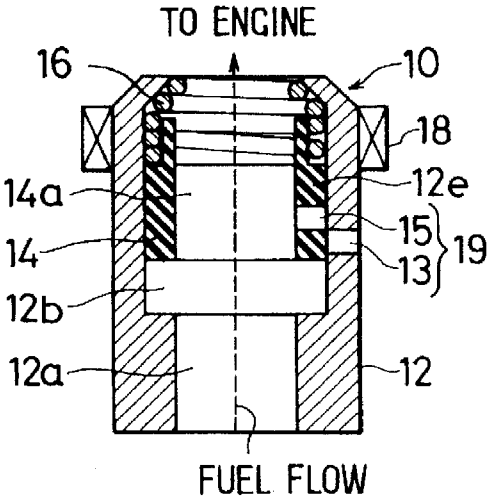

When the voltage applied to an electromagnetic coil is further increased, electromagnetic attracting force also generally increases. Accordingly, the electromagnetic attracting force generated by the coil 18 increases in accordance with the voltage increase applied to coil 18. Then, the movable portion 14 further moves toward the fuel downstream side as shown in FIG. 3C, so that the opening of the first communication passage 15 of the movable portion 14 is again closed by the interior wall 12*e* of the sliding hole 12*b*. Therefore, communication between the first communication passage 15 and the second communication passage 13 forming the drain passage 19 is interrupted.

An operation of the flow control valve 10 will be described based on FIGS. 3 and 4.

When the engine is in a stopping or starting condition, voltage supplied to the fuel pump 2 is set to 0 V or the lowest voltage. Therefore, voltage applied to the coil 18 of the flow control valve 10 is also 0 V or the lowest voltage. In this state, an electromagnetic attracting force is not generated or an extremely small electromagnetic attracting force is generated by the coil 18, the movable portion 14 maintains itself is biased toward the fuel upstream side by the compression coil spring 16. In this case, first communication passage 15 of the movable portion 14 and second communication passage 13 of the housing 12 do not communicate with each other as shown in FIG. 3A, thereby the communication of drain passage 19 is interrupted. Even if fuel flows into the fuel passage 12*a* by operation of the fuel pump after the engine 8 starts, fuel does not flow into the fuel tank 1 through the drain passage 19 but is instead all supplied to the engine 8 through the fuel passage 14*a*. Therefore, it is possible to obtain a necessary fuel pressure in starting the engine 8 as well as to start up the engine 8 smoothly.

When the engine is in an operating condition where the required fuel amount is comparatively low such as idling or normal operation (a light or a middle load operating condition), voltage applied to the fuel pump 2 is set to a comparatively low voltage. Then, since voltage applied to the coil 18 is also set to a comparatively low voltage, a comparatively small electromagnetic force is generated by the coil 18. The movable portion 14 is attracted to the fuel downstream side with a predetermined distance by the electromagnetic attracting force. At that time, as shown in FIG. 3B, the first passage 15 of the movable portion 14 and the second passage 13 of the housing 12 communicate with each other, thereby the drain passage 19 is communicated. In this way, fuel flowing into fuel passage 12*a* and fuel passage 14*a* leaks from flow control valve 10 through drain passage 19 and is drained back into the fuel tank 1. That is, a part of the fuel pump 2 discharge is drained back to fuel tank 1 and the remaining pumped fuel is delivered to engine 8. Thus, even if the required fuel amount for engine 8 is extremely small such as only a few liter/h, the amount of fuel supplied from fuel pump 2 does not become a few liter/h or extremely small, because fuel including the leaked fuel which will be drained back to fuel tank 1 is discharged, and therefore, rotation of fuel pump 2 can be stabilized.

When engine 8 is in a condition of maximum output operation (a full load condition), voltage applied to the fuel pump 2 is set high. Then, voltage applied to the coil 18 also is set to a high value and, as a result, a large amount of electromagnetic force is generated by coil 18. The movable portion 14 is further attracted toward the fuel downstream side and approaches coil 18 most closely as shown in FIG. 3C. At that time, communication between first passage 15 of the movable portion 14 and second passage 13 of housing 12 is again interrupted by the interior wall 12*e* of the sliding hole 12*b*, thereby interrupting drain passage 19. In this way, since fuel in the fuel passage 12*a* and the fuel passage 14*a* does not leak back to fuel tank 1 through drain passage 19, all of the fuel supplied by fuel pump 2 can be supplied engine 8. Therefore, the fuel amount according to the requirement of engine 8 can be supplied without any waste.

Figure 4:
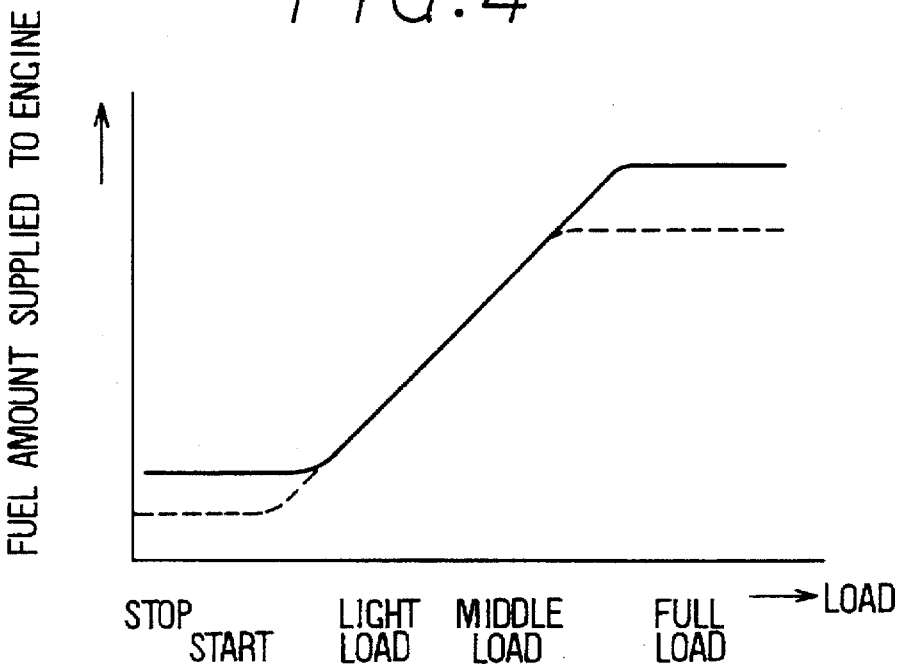
FIG. 4 is a graph showing characteristics of a fuel supply amount with respect to a load condition of an engine.

The characteristics of changing the fuel amount supplied to engine 8 depending on the above respective operating conditions of engine 8 are shown in FIG. 4.

In FIG. 4, the solid line shows a fuel supply amount having flow control valve 10 according to this embodiment, whereas the dotted line shows a fuel supply amount supplied by a fuel supply apparatus having a drain orifice which always communicates with the downstream side of a fuel pump.

It can be understood that the fuel supply amount according to the characteristic shown by the solid line increases more than that shown by the dotted line when the engine is in a stopping or starting condition. In the characteristic shown by the dotted line, the fuel supply amount decreases more than that of a fuel supply apparatus having the fuel control valve 10, because the supply fuel always leaks from the orifice which is always open.

However, when the engine is in a light load or a middle load operating condition, both the fuel supply apparatuses show the same characteristic, because a part of the supply fuel is drained back to the fuel tank.

When the engine is in a full load operating condition, similar to when the engine is in a stopping or starting condition, the fuel supply amount according to the characteristic shown by the dotted line decreases more than that of a fuel supply apparatus having the flow control valve 10, because a part of the supplied fuel leaks from the orifice, which is always open, back into the fuel tank by the same reason as the above.

According to the aforementioned first embodiment, when the engine 8 is in no load condition or full load operating condition, the fuel passing through the fuel passages 12*a* and 14*a* does not flow outside the flow control valve 10 through the drain passage 19 due to interruption of the communication between the first communication passage 15 and the second communication passage 13 for forming the drain passage 19 depending on the moving position of the movable portion 14. On the other hand, when the engine 8 is in a light or a middle load operating condition, since the drain passage 19 is communicated depending on the moving position of the movable portion 14, the fuel passing through the fuel passages 12*a* and 14*a* is discharged outside the flow control valve 10 through the drain passage 19.

In this way, when engine 8 is in a starting condition, fuel is not discharged from the fuel pump 2 out of the flow control valve 10 through the drain passage 19, i.e., the fuel is not drained to the fuel tank 1, and necessary fuel pressure is secured, thereby starting engine 8 effectively and smoothly. Even in a full load condition of engine 8, since fuel discharged from fuel pump 2 is not drained to fuel tank 1, a sufficient amount of fuel required for engine 8 can be supplied without any waste. Furthermore, in a light or a middle load condition of engine 8, the discharge fuel from fuel pump 2 is released outside flow control valve 10 through drain passage 19 to fuel tank 1, i.e., fuel is drained back to fuel tank 1, so that the fuel supply amount delivered by fuel pump 2 does not become an extremely small amount (a few liter/h), because fuel including leaked fuel drained back to the fuel tank 1 is discharged by the fuel pump 2. Therefore, rotation of the fuel pump 2 can be stabilized and capacity of fuel pump 2 can be rapidly increased to respond closely to high fuel demand.

A flow control valve of a fuel supply apparatus according to a second embodiment of the present invention will be described with reference to FIGS. 5–7.

Figure 5:
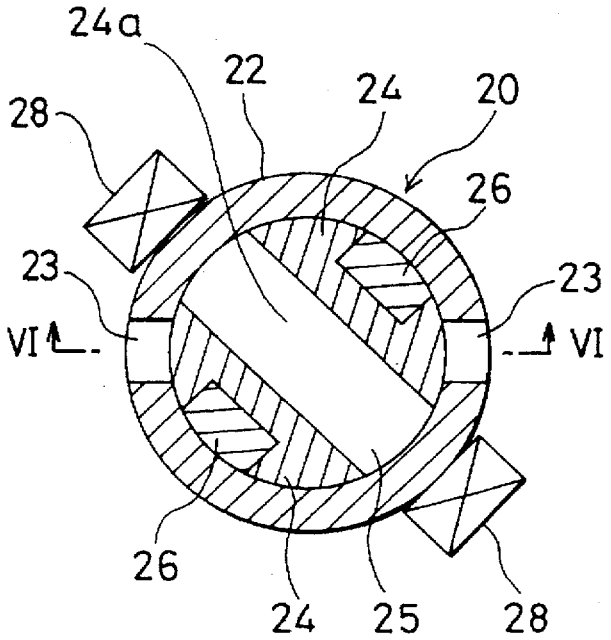
FIG. 5 is a schematic top plan view of a flow control valve of a fuel supply apparatus according to a second embodiment of the present invention.
Figure 6:
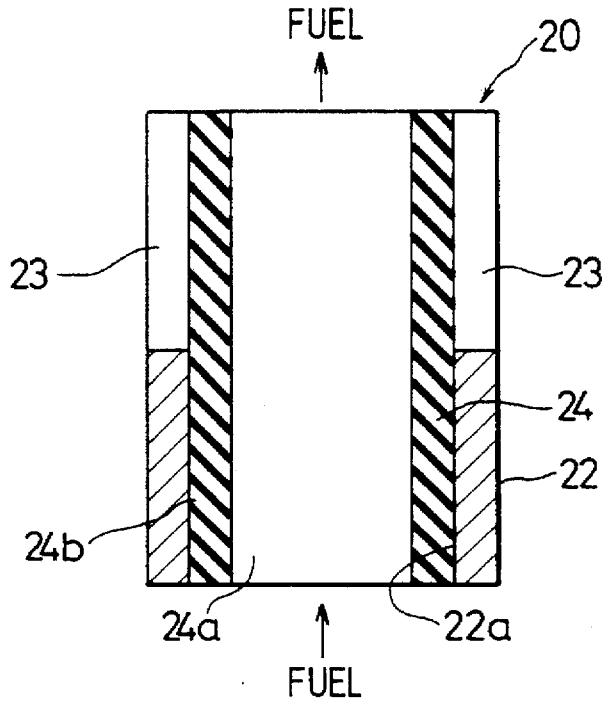
FIG. 6 is a cross-sectional view taken along the line VI—VI of FIG. 5.

The second embodiment shown in FIGS. 5–7 differs from the first embodiment in that a movable portion 24 moving in a sliding hole 22*a* of a housing 22 slides not in the axial direction but in the peripheral (i.e., circumferential) direction of the sliding hole 22*a*.

A flow control valve 20 as shown in FIGS. 5 and 6 includes a housing 22, a movable portion 24, a magnetic member 26, a coil 28 and a return spring (not shown), and is integrated with a fuel pump or separated from the fuel pump in the same manner as the flow control valve 10 described in the first embodiment.

The cylindrical housing 22 made of non-magnetic material forms a sliding hole 22*a* where the movable portion 24 (described below) is slidable in the housing 22. A plurality of slit-like second communication passages 23 extending to the fuel downstream side from the substantially center in the axial direction on the peripheral wall of the housing 22 is formed. These second communication passages 23 are located at a position so as to communicate with a first communication passage 25 in the movable portion 24 (described below). When the housing 22 is molded, the slit-like second communication passages 23 can be simultaneously molded.

The cylindrical movable portion 24 made of magnetic (e.g., ferromagnetic) material having a slightly smaller outer diameter than the inner diameter of the sliding hole 22*a* of the housing 22. Therefore, the movable portion 24 is slidably accommodated in the housing 22 in the peripheral (circumferential) direction in the sliding hole 22*a*. A fuel passage 24*a* through which the fuel delivered by the fuel pump can pass is formed in the movable portion 24. The slit-like first communication passage 25, extending from substantially the center in the axial direction to the fuel downstream side similar to the housing 22, is formed on the peripheral wall of the movable portion 24 with the second communication passages 23. In the same manner as in the second communication passages 23, the first communication passage 25 can be molded simultaneously with the second communication passages 23 when the movable portion 24 is molded. Furthermore, the movable portion 24 includes the magnetic member 26 made of magnetic material therein, which is attracted by electromagnetic attracting force generated by the coil 28 (described below).

The coil 28 is wound around the outer peripheral wall located on the fuel downstream side of the housing 22. The magnetic member 26 made of the magnetic material is attracted toward the coil 28 by the electromagnetic attracting force generated by electric supply to the coil 28. Then the movable portion 24 being slidable in the peripheral direction inside the sliding hole 22*a* of the housing 22 rotates in the predetermined direction. An amount of the rotation of the movable portion 24 is controlled by the amount of voltage applied to the coil 28.

When electric supply to the coil 28 is interrupted or applied voltage is set low, the movable portion 24 rotates reversely with respect to the predetermined rotational direction because of a spring force of the return spring (not shown) biasing the movable portion 24 to rotate in the reverse direction. The movable portion 24 is located at a predetermined position when electric current is not supplied to the coil 28 by a spring force of the return spring biasing the movable portion 24 in the reverse direction, as shown in FIG. 7A.

Figure 7A:
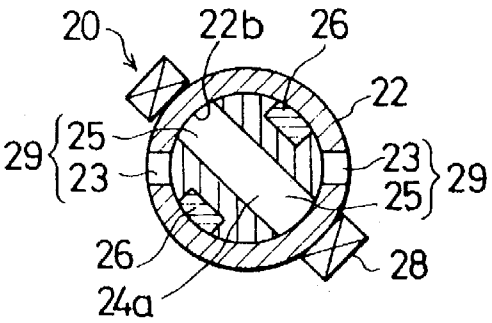
FIGS. 7A–7F show operations of the flow control valve of the second embodiment.
Figure 7B:
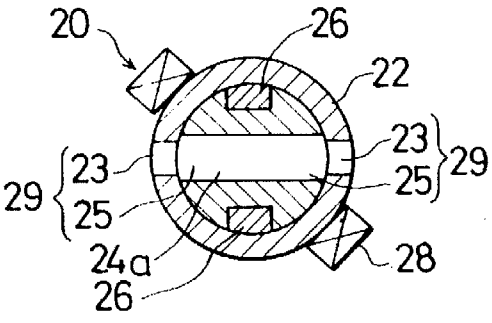
Figure 7C:
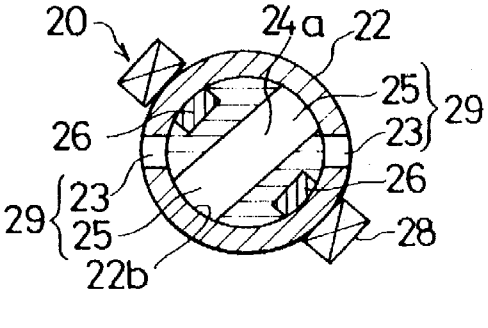
Figure 7D:
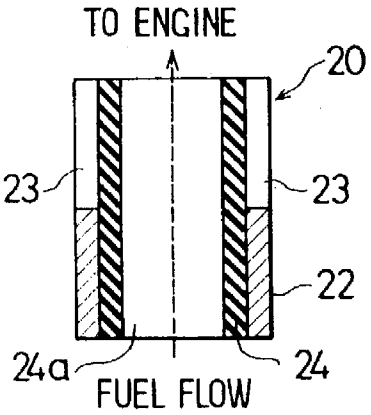
Figure 7E:
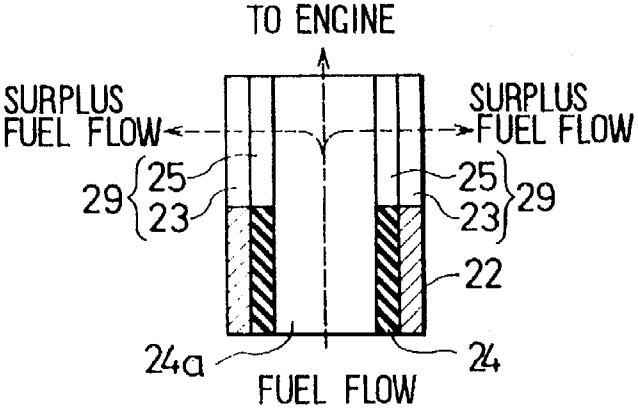
Figure 7F:
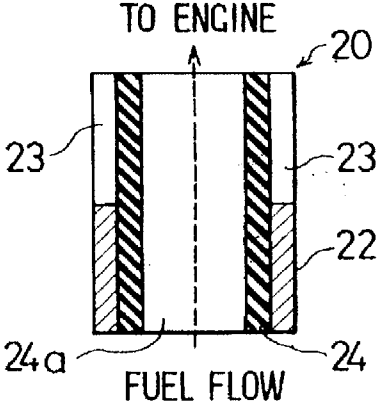

An operation of the flow control valve 20 will be described based on FIGS. 7A–7F, in which FIGS. 7A, 7C and 7E are top plan views of the flow control valve 20 corresponding to FIG. 5 while FIGS. 7B, 7D and 7F are longitudinal cross-sectional views corresponding to FIG. 6. That is, FIGS. 7A–7F illustrate top plan and longitudinal cross-sectional views of the flow control valve 20 at respective load conditions of the engine.

When the engine is in a stopping or starting condition, since voltage supplied to the fuel pump is set to 0 V or the lowest voltage, a voltage applied to the coil 28 of the flow control valve 20 is also 0 V or the lowest voltage. In this state, since no or an extremely small electromagnetic attracting force is generated, the movable portion 24 maintains the position where the movable portion 24 is biased toward the predetermined position by the return spring. In this case, the first communication passage 25 of the movable portion 24 and the second communication passage 23 of the housing 22 do not communicate with each other as shown in FIG. 7A, thereby the communication of the drain passage 19 being interrupted. Even if fuel flows into the fuel passage 24*a* when the fuel pump is operated after the engine starts, the fuel does not flow into the fuel tank through the drain passage 29 but is supplied to the engine through the fuel passage 24*a*. Therefore, it is possible to obtain a necessary fuel pressure in starting the engine as well as to start up the engine smoothly in the same manner as by the flow control valve 10 in the first embodiment.

When the engine is in an operating condition where the required fuel amount is comparatively low such as idling or a normal operation (a light or a middle load operating condition), since a voltage applied to the fuel pump is set to a comparatively low voltage and similarly a voltage applied to the coil 28 is set to a comparatively low voltage, a comparatively small electromagnetic force is generated by the coil 28. The movable portion 24 moves and rotates by a predetermined angle in the predetermined rotational direction with the electromagnetic attracting force. At that time, the first passage 25 of the movable portion 24 and the second passage 23 of the housing 22 communicate with each other, thereby the drain passage 29 being communicated as shown in FIG. 7B. In this way, fuel flowing into the fuel passage 24*a* is drained into the fuel tank after leaking from the flow control valve 20 through the drain passage 29. Therefore, it is possible to stabilize the rotation of the fuel pump in the same manner as by the flow control valve 10 in the first embodiment.

When the engine is in the maximum output operation (a full load condition), a voltage applied to the fuel pump is set high, and similarly a voltage applied to the coil 28 is set to a high value. As a result, the movable portion 24 rotates and moves further in the predetermined rotational direction and the magnetic member 26 approaches the coil 28 most closely as shown in FIG. 7C. At that time, the communication between the first passage 25 of the movable portion 24 and the second passage 23 of the housing 22 is interrupted by the interior wall 22*b* of the sliding hole 22*a* again, thereby the communication of the drain passage 29 being interrupted. The movement of the movable portion 24 in the peripheral direction communicates the second communication passages 23 with the opening of the first communication passage or the communication is interrupted by the interior wall 22*b* of the sliding hole 22*a*. The movable portion 24 and the interior wall 22*b* constitute valve means.

In this way, since the fuel in the fuel passage 24*a* does not leak to the fuel tank through the drain passage 29, all of the fuel delivered by the fuel pump can be supplied to the engine. Therefore, it is possible to supply a fuel amount required for the engine without any waste in the same manner as by the flow control Valve 10 of the first embodiment.

According to the second embodiment, since both the second communication passages 23 formed in the housing 22 and the first communication passage 25 formed in the movable portion 24 have the shape of a slit, these passages 23 and 25 can be molded simultaneously when the housing 22 or the movable portion 24 is molded. In this way, another process for forming the first communication passage 25 and the second communication passages 23 is not necessary. Since the number of manufacturing processes can be reduced compared with a case when the flow control valve 10 according to the first embodiment is used, the manufacturing cost can be reduced.

In the first and second embodiments, the voltage applied to the coils 18 and 28 is increased or decreased depending on a voltage value applied to the fuel pump 2, however, it can be controlled individually based on various information with reference to the engine or the like from the ECU.

A flow control valve of a fuel supply apparatus according to a third embodiment of the present invention will be described with reference to FIGS. 8 and 9.

Figure 8:
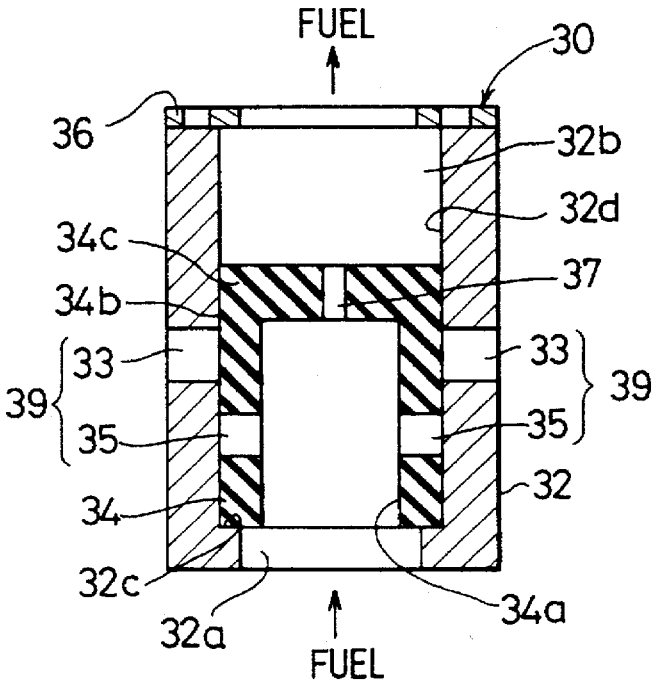
FIG. 8 is a longitudinal cross-sectional view of a fuel supply apparatus according to a third embodiment of the present invention.

The third embodiment shown in FIGS. 8 and 9 differs from the first embodiment in that a movable portion 34 moving in a sliding hole 32*b* of a housing 32 is formed in a cylindrical shape with a bottom and the bottom 34*c* of the movable portion 34 has an orifice.

A flow control valve 30 as shown in FIGS. 8 and 9 includes a housing 32, a movable portion 34, and a cover 36, and is integrated with a fuel pump or separated from the fuel pump in the same manner as the flow control valve 10 described in the first embodiment.

In the cylindrical housing 32, a sliding hole 32*b* having a larger diameter than a fuel passage 32*a* is formed and communicates with a fuel passage 32*a* on the fuel downstream side of the fuel passage 32*a* formed at one end of the housing 32. The sliding hole 32*b* is formed at the other end of the housing 32 to pass through inside the housing 32. A stopper 32*c* adopted to contact with one end of the movable portion 34 (described below) is formed at the connecting portion between the fuel passage 32*a* and the sliding hole 32*b*. The cover 36, having a smaller diameter hole than the inner diameter of the sliding hole 32*d*, is located at the opening of the fuel downstream side of the sliding hole 32*b*. The movement of the movable portion 34 is restricted by a contact of the other edge of the movable portion 34 accommodated in the sliding hole 32*b* with the cover 36. A plurality of second communication passages 33 communicating the interior with the exterior of the housing are disposed at the substantially center in the axial direction of the sliding hole 12*b*. The second communication passages 33 form a drain passage 39 by communicating with a first communication passage 35 formed in the movable portion 34 (described below).

The cylindrical movable portion 34 with a bottom has a slightly smaller outer diameter than the inner diameter of the sliding hole 32*b* of the housing 32. Accordingly, the movable portion 34 is accommodated in the housing 32 so as to be slidable in the axial direction in the sliding hole 32*b*. A fuel passage 34*a* through which supplied fuel pressurized and supplied by a fuel pump is disposed in the movable portion 34. A first communication passages 35, the number of which is the same as that of second communication passages 33, for communicating the interior with the exterior of the movable portion 34 are formed on the peripheral wall of the movable portion 34 in the housing 32. Furthermore, an orifice 37 for communicating the interior of the movable portion 34 with the exterior thereof is formed at the bottom 34*c* of the movable portion 34.

Since the movable portion 34 accommodated in the sliding hole 32*b* can move in the axial direction, i.e., upward or downward in the sliding hole 32*b* in FIG. 8, the opening of the first communication passages 35 of the movable portion 34 communicates with the second communication passages 33 of the housing 32 or is closed by the interior wall 32*d* of the sliding hole 32*b* depending on the position of the movable portion 34 moving in the axial direction. The movable portion 34 and the interior wall 32*d* constitute valve means.

Because the orifice 37 is located at the bottom 34*c* of the movable portion 34, fuel flowing into the fuel passage 34*a* is supplied to the engine through the orifice 37. On the other hand, a pressure of the fuel flowing into the fuel passage 34*a* acts on the bottom 34*c*, so that the movable portion 34 can be moved to the fuel downstream side by the fuel pressure flowing therein. Since a fuel pressure loss due to the orifice 37 is proportional to the square of a fuel discharge amount of the fuel pump, a moving amount of the movable portion 34 can be controlled by the fuel discharge amount of the fuel pump. Accordingly, by controlling a discharge amount of the fuel pump by the ECU (not shown) or the like without using a coil for generating electromagnetic attracting force such as the flow control valve 10 of the first embodiment, the movable portion 34 can be moved to the fuel downstream side freely by the mechanical structure.

When a fuel discharge amount of the fuel pump is small, it is necessary for the movable portion 34 to be positioned on the fuel upstream side. Therefore, the movable portion 34 has to be biased toward the fuel upstream side by a predetermined spring force. For example, by installing the flow control valve 30 in such s manner that the fuel upstream side is located in the gravity direction, it is possible to biases the movable portion 34 to the fuel upstream side. In case the fuel upstream side cannot be located in the gravity direction due to an installation position of the flow control valve 30, the movable portion 34 can be biased toward the fuel upstream side by accommodating a compression coil spring between the movable portion 34 and the cover 36.

An operation of the flow control valve 30 will be described based on FIG. 9.

Figure 9A:
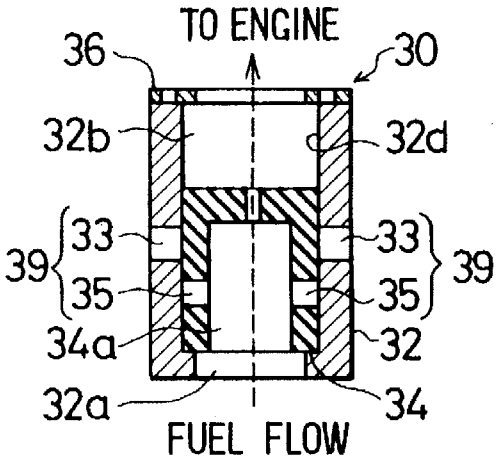
FIGS. 9A–9C show operations of the flow control valve of the third embodiment.

When the engine is in a stopping or starting condition, a voltage supplied to the fuel pump is set to 0 V or the lowest voltage. Therefore, since a fuel amount discharged by the fuel pump is 0 or extremely small, the movable portion 34 does not move to the fuel downstream side but maintains a position as to be biased to the fuel upstream side by the gravity or a compression coil spring or the like. In this case, the first communication passages 35 of the movable portion 34 and the second communication passages 33 of the housing 32 do not communicate with each other as shown in FIG. 9A, thereby the communication of the drain passage 39 being interrupted. Even if fuel flows into the fuel passage 34*a* when the fuel pump is operated after the engine starts, the fuel does not flow into the fuel tank through the drain passage 39 but is supplied to the engine through the fuel passage 34*a*. Therefore, it is possible to obtain a necessary fuel pressure in starting the engine as well as to start up the engine smoothly in the same manner as by the flow control valve 10 in the first embodiment.

Figure 9B:
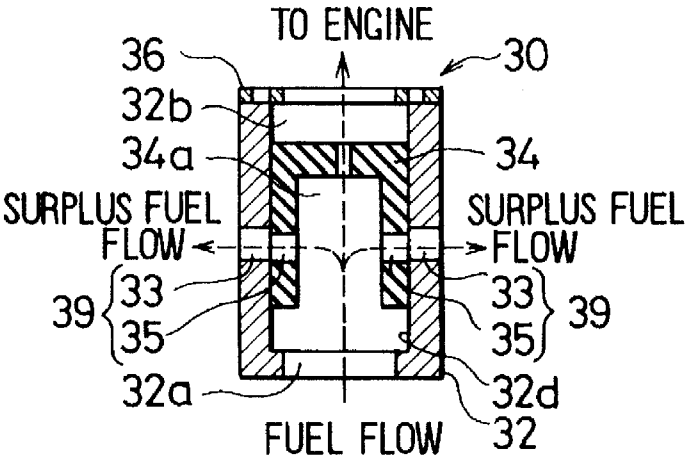

When the engine is in an operating condition where the required fuel amount is comparatively low such as idling or a normal operation (a light or a middle load operating condition), since a voltage applied to the fuel pump is set to a comparatively low voltage. As a result, a fuel amount supplied to the flow control valve 30 from the fuel pump is in a range of a predetermined amount. The movable portion 34 moves with the predetermined distance to the fuel upstream side by the pressing force due to pressure loss which is in proportion to the square the predetermined fuel discharge amount. At that time, the first passages 35 of the movable portion 34 and the second passages 33 of the housing 32 communicate with each other as shown in FIG. 9B, thereby a communication of the drain passage 39 being interrupted. In this way, fuel flowing into the fuel passage 34*a* is released into the fuel tank after leaking from the flow control valve 30 through the drain passage 39. Therefore, it is possible to stabilize the rotation of the fuel pump in the same manner as by the flow control valve 10 in the first embodiment.

Figure 9C:
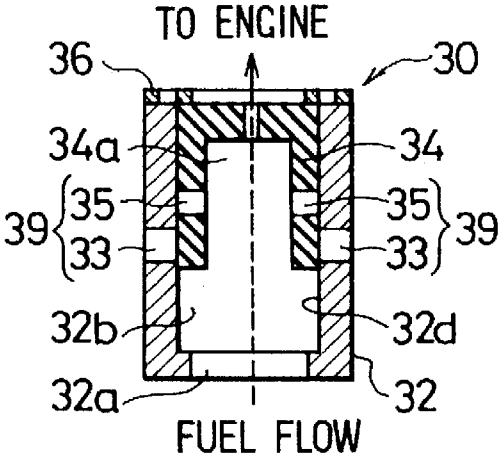

When the engine is in an operating condition of the maximum output (a full load condition), a voltage applied to the fuel pump is set high. Then, a fuel amount supplied to the flow control valve 30 from the fuel pump exceeds the range of the predetermined amount. The movable portion 34 moves until it contacts with the cover 36 as shown in FIG. 9C by a pressing force due to the pressure loss in proportion to the square of the increased fuel discharge amount. Accordingly, a communication of the first communication passages 35 of the movable portion 34 with the second communication passages 33 of the housing 32 is interrupted, thereby the communication of the discharging pipe 39 being interrupted. Thus, fuel in the fuel passage 34*a* does not leak to the fuel tank through the drain passage 39, so that all of the fuel supplied from the fuel pump can be supplied to the engine. Therefore, it is possible to supply a fuel amount required for the engine without any waste in the same manner as by the flow control valve 10 in the first embodiment.

According to the third embodiment, because the movable portion 34 sliding in the housing 32 can move to the fuel downstream side by a fuel pressure flowing therein by controlling a discharge amount of the fuel pump with the ECU or the like, the movable portion 34 can be freely moved to the fuel downstream side by the mechanical structure. In this way, since the movable portion 34 can be moved to the fuel downstream side without a coil for generating electromagnetic attracting force such as the flow control valve 10 of the first embodiment, it is possible to reduce the number of parts as well as manufacturing cost.

Furthermore, the movable portion 34 can be biased to the fuel upstream side by installing the flow control valve 30 in such a manner that the fuel upstream side is located in the gravity. Accordingly, without a compression coil spring for biasing the movable portion toward the fuel upstream side such as the flow control valve 10 of the first embodiment, the number of parts can be further reduced as well as the manufacturing cost.

Although the present invention has been fully described in connection with the preferred embodiments thereof with reference to the accompanying drawings, it is to be noted that various changes and modifications will become apparent to these skilled in the art. Such changes and modifications are to be understood as being included within the scope of the present invention as defined by the appended claims.

What is claimed is:

1. A fuel supply apparatus for an internal combustion engine, said apparatus comprising:

a fuel tank for storing fuel;

a fuel supply pipe for supplying fuel into said engine;

a fuel pump for pumping fuel from said fuel tank and discharging fuel in an amount which is controlled according to an engine requirement into said fuel supply pipe; and drain control means disposed on a discharge side of said fuel pump for controlling the amount of fuel discharged from said fuel pump to said fuel supply pipe, wherein said drain control means drains part of the fuel discharged from said fuel pump back into said fuel tank in a low load engine operating condition and stops draining fuel back to said tank in a high load engine operating condition, wherein said drain control means is disposed between said fuel pump and said fuel supply pipe and includes a drain passage for draining fuel discharged from said fuel pump out of said fuel supply pipe and valve means for opening or closing said drain passage according to an engine load condition, said valve opening said drain passage in a light load or a middle load engine operation, said valve closing said drain passage in a full engine load condition, and said valve means closing said drain passage when said engine is in a stopping condition or in a starting condition.

2. A fuel supply apparatus as in claim 1, wherein said fuel pump is electrically operated.

3. A fuel supply apparatus as in claim 2, wherein said fuel pump includes an electric motor which is electrically operated.

4. A fuel supply apparatus as in claim 1 wherein:

fuel discharged from said fuel pump is supplied to said fuel supply pipe through a fuel supply passage formed on an upstream side of said drain control means.

5. A fuel supply apparatus as in claim 1, wherein said fuel pump is disposed in said fuel tank.

6. A fuel supply apparatus as in claim 1, further comprising:

a fuel injector connected to said fuel supply pipe for injecting fuel into said engine.

7. A fuel supply apparatus for an internal combustion engine, said apparatus comprising:

a fuel tank for storing fuel;

a fuel supply pipe for supplying fuel into said engine;

a fuel pump for pumping fuel from said fuel tank and discharging fuel in an amount which is controlled according to an engine requirement into said fuel supply pipe; and drain control means disposed on a discharge side of said fuel pump for controlling the amount of fuel discharged from said fuel pump to said fuel supply pipe;

wherein said drain control means drains part of the fuel discharged from said fuel pump back into said fuel tank in a low load engine operating condition and stops draining fuel back to said tank in a high load engine operating condition, wherein, said drain control means is disposed between said fuel pump and said fuel supply pipe and includes a drain passage for draining fuel discharged from said fuel pump out of said fuel supply pipe and valve means for opening or closing said drain passage according to an engine load condition, said valve opening said drain passage in a light load or a middle load engine operation, said valve closing said drain passage in a full load engine operations and wherein said drain amount control means includes:

a cylindrical body for forming a fuel passage therein through which said fuel discharged by said fuel pump passes and a first communication passage for forming a part of said drain passage; and a housing for forming a sliding hole accommodating said cylindrical body slidably therein and a second communication passage for forming the remaining part of said drain passage; au opening of said first communication passage on a side of said second communication passage being opened or closed by moving said cylindrical body relatively to said housing.

8. A fuel supply apparatus as in claim 7, wherein said cylindrical body moves relative to said housing in an axial direction of said sliding hole.

9. A fuel supply apparatus as in claim 7, wherein said cylindrical body moves relative to said housing in a peripheral direction of said sliding hole.

10. A fuel supply apparatus for an internal combustion engine, said apparatus comprising:

a fuel tank for storing fuel;

a fuel supply pipe for supplying fuel into said engine;

a fuel pump for pumping fuel from said fuel tank and discharging a required fuel mount according to an engine requirement into said fuel supply pipe;

discharge control means for controlling said fuel pump to discharge a larger amount of fuel than said required fuel amount to said supply pipe in a low load engine operating condition; and drain control means for draining a part of fuel discharged from said pump back into said fuel tank, wherein said drain control means drains a differential fuel amount between said discharge fuel amount to said supply pipe and said required fuel amount in a low load engine operating condition and stops draining fuel in the other load engine operating conditions, and wherein, said drain control means is disposed between said fuel pump and said fuel supply pipe and includes a drain passage for draining fuel discharged from said fuel pump out of said fuel supply pipe and valve means for opening or closing said drain passage according to an engine load condition, said valve opening said drain passage in a light load or a middle load engine operation, said valve closing said drain passage in a full engine load condition, and said valve means closing said drain passage when said engine is in a stopping condition or in a starting condition.

11. A fuel supply apparatus as in claim 10, wherein said fuel pump is electrically operated.

12. A fuel supply apparatus as in claim 11, wherein said fuel pump includes an electric motor which is electrically operated.

13. A fuel supply apparatus as in claim 10, wherein fuel discharged from said fuel pump is supplied to said fuel pipe through a fuel supply passage formed on an upstream side of said drain amount control means.

14. A fuel supply apparatus for an internal combustion engine, said apparatus comprising:

a fuel tank for storing fuel;

a fuel supply pipe for supplying fuel into said engine;

a fuel pump for pumping fuel from said fuel tank and discharging a required fuel amount according to an engine requirement into said fuel supply pipe;

discharge control means for controlling said fuel pump to discharge a larger amount of fuel than said required fuel amount to said supply pipe in a low load engine operating condition; and drain control means for draining a part of fuel discharged from said pump back into said fuel tank, wherein said drain control means drains a differential fuel amount between said discharge fuel amount to said supply pipe and said required fuel amount in a low load engine operating condition and stops draining fuel in the other load engine operating conditions, wherein said drain control means is disposed between said fuel pump and said fuel supply pipe and includes a drain passage for draining fuel discharged from said furl pump out of said fuel supply pipe and valve means for opening or closing said drain passage according to an engine load condition, wherein said valve opening said drain passage in a light engine load or a middle engine load condition, wherein said valve closing said drain passage in a full engine load condition, and wherein said drain control means includes:

a cylindrical body forming a fuel passage therein through which said fuel discharged by said fuel pump passes and a first communication passage forming part of said drain passage; and a housing for forming a sliding hole slidably accommodating said cylindrical body and a second communication passage forming the remaining part of said drain passage; an opening of said first communication passage on a side of said second communication passage being opened or closed by moving said cylindrical body relative to said housing.

15. A fuel supply apparatus as in claim 14, wherein said cylindrical body moves relative to said housing in an axial direction of said sliding hole.

16. A fuel supply apparatus as in claim 14, wherein said cylindrical body moves relative to said housing in a peripheral direction of said sliding hole.

17. A method for controlling pumped fuel flow to an internal combustion engine in accordance with engine load operating conditions, said method comprising:

causing controlled leakage of a portion of pumped fuel flow back to a fuel supply tank during a predetermined range of engine load operating conditions, and substantially stopping said leakage of pumped fuel flow during engine starting, and high-range engine load operating conditions respectively below and above said predetermined range of engine load operating conditions thereby causing a relative increase in fuel flow to the engine at both engine starting and high engine load conditions.

18. A method as in claim 17 wherein said substantially stopping step is achieved by causing relative motion between two passages formed in relatively slidable parts of a fuel supply line to the engine, the fuel pump and relatively slidable parts all being disposed within a fuel supply tank.

* * * * *